US010832611B2

(12) United States Patent
Xi et al.

(10) Patent No.: US 10,832,611 B2
(45) Date of Patent: Nov. 10, 2020

(54) MULTIPLE PRIMARY COLOR CONVERSION METHOD, DRIVING METHOD, DRIVING DEVICE AND DISPLAY APPARATUS

(71) Applicant: BOE TECHNOLOGY GROUP CO., LTD., Beijing (CN)

(72) Inventors: Yanhui Xi, Beijing (CN); Bin Dai, Beijing (CN); Xiaomang Zhang, Beijing (CN); Yan Sun, Beijing (CN); Haijun Niu, Beijing (CN); Kuanjun Peng, Beijing (CN); Yuxin Bi, Beijing (CN); Donghui Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/473,543

(22) PCT Filed: Nov. 13, 2018

(86) PCT No.: PCT/CN2018/115192
§ 371 (c)(1),
(2) Date: Jun. 25, 2019

(87) PCT Pub. No.: WO2019/114479
PCT Pub. Date: Jun. 20, 2019

(65) Prior Publication Data

US 2020/0143732 A1 May 7, 2020

(30) Foreign Application Priority Data

Dec. 15, 2017 (CN) ..... 2017 1 1351035

(51) Int. Cl.
*G09G 3/20* (2006.01)

(52) U.S. Cl.
CPC ... *G09G 3/2003* (2013.01); *G09G 2320/0666* (2013.01); *G09G 2340/06* (2013.01)

(58) Field of Classification Search
CPC ..... G09G 3/2003; G09G 2320/0666; G09G 2340/06
See application file for complete search history.

(56) References Cited

U.S. PATENT DOCUMENTS 9,317,939 B2 4/2016 Yang et al.
9,324,286 B2 4/2016 Mori et al.
(Continued)

FOREIGN PATENT DOCUMENTS

CN 101944335 A 1/2011
CN 102227675 A 10/2011
(Continued)

OTHER PUBLICATIONS

International Search Report dated Feb. 12, 2019 for corresponding PCT/CN2018/115192.
(Continued)

*Primary Examiner* — Sejoon Ahn
(74) *Attorney, Agent, or Firm* — Nath, Goldberg & Meyer; Joshua B. Goldberg

(57) ABSTRACT

The present application provides a multiple primary color conversion method, including: determining color triangles according to color coordinates of a target color; computing grayscale components of l primary colors corresponding to the target color in the color triangles; in step S130, obtaining initial grayscales of l primary colors; in step S140, judging whether there is an overflow grayscale; if yes, then performing step S160, if no, then performing step S150; in step S150, adjusting initial brightness components corresponding to grayscale components of the same primary color as the overflow grayscale, computing grayscale components of l
(Continued)

primary colors in color triangles including the primary color of the overflow grayscale, and performing steps S130 and S140; in step S160, determining the initial grayscales of l primary colors as grayscales of l primary colors of the target color.

20 Claims, 3 Drawing Sheets

(56) References Cited

U.S. PATENT DOCUMENTS

| | | | | |
|---|---|---|---|---|
| 9,886,881 | B2 | 2/2018 | Zhang et al. | |
| 10,410,588 | B2 | 9/2019 | Fan | |
| 2009/0238456 | A1 | 9/2009 | Fukasawa | |
| 2012/0001963 | A1 | 1/2012 | Hinnen et al. | |
| 2015/0235615 | A1 | 8/2015 | Yoshida et al. | |
| 2016/0358580 | A1* | 12/2016 | Takahashi | G06F 3/04897 |
| 2016/0358581 | A1* | 12/2016 | Perlow | G09G 3/2003 |
| 2016/0358584 | A1* | 12/2016 | Greenebaum | G06T 1/20 |
| 2016/0360348 | A1* | 12/2016 | Ueda | G09G 5/00 |
| 2016/0364626 | A1* | 12/2016 | Sasaki | G06K 9/4671 |
| 2016/0364888 | A1* | 12/2016 | Jeon | G09G 3/2003 |
| 2017/0076654 | A1* | 3/2017 | Wang | G09G 3/2074 |
| 2017/0076660 | A1* | 3/2017 | Lee | G09G 3/3208 |

FOREIGN PATENT DOCUMENTS

| | | | |
|---|---|---|---|
| CN | 102349300 | A | 2/2012 |
| CN | 103218988 | A | 7/2013 |
| CN | 104091578 | A | 10/2014 |
| CN | 106057120 | A | 10/2016 |
| CN | 106486074 | A | 3/2017 |
| CN | 107945729 | A | 4/2018 |
| JP | 2017181834 | A | 10/2017 |

OTHER PUBLICATIONS

First Office Action, dated Nov. 5, 2019, of corresponding CN201711351035.X with English translation.

* cited by examiner

MULTIPLE PRIMARY COLOR CONVERSION METHOD, DRIVING METHOD, DRIVING DEVICE AND DISPLAY APPARATUS

CROSS-REFERENCE TO RELATED APPLICATIONS

This is a National Phase Application filed under 35 U.S.C. 371 as a national stage of PCT/CN2018/115192, filed Nov. 13, 2018, an application claiming the benefit of Chinese Patent Application No. CN201711351035.X, filed on Dec. 15, 2017, the contents of which are incorporated herein in their entirety by reference.

TECHNICAL FIELD

The present disclosure relates to the field of display technology, and in particular, relates to a multiple primary color conversion method, a driving method and a driving device for driving a display panel, and a display apparatus.

BACKGROUND

With the continuous development of display technology, requirements for resolution and performance of a display panel are becoming higher and higher. The existing three-primary-color (i.e. RGB) display panel has limited display ability. Thus, there has been developed six-primary-color (i.e. RGBYeCM) display panel. The six-primary-color display panel includes a plurality of display pixels, each of the display pixels includes a red display sub-pixel, a green display sub-pixel, a blue display sub-pixel, a yellow display sub-pixel, a cyan display sub-pixel, and a magenta display sub-pixel.

SUMMARY

The present disclosure provides a multiple primary color conversion method, a driving method and a driving device for driving a display panel, and a display apparatus. By using the method one can obtain a more accurate six-primary-color stimulus value, thereby can improve display effect of the display panel.

As an aspect of the present application, there is provided a multiple primary color conversion method, for computing grayscales of l primary colors of a target color in an l-primary-color color gamut space according to color information of the target color, wherein l is a positive integer greater than 3, the color information of the target color includes color coordinates of the target color and a brightness of the target color, wherein, the multiple primary color conversion method includes:

in step S110, determining at least one color triangles corresponding to the target color in an l-primary-color system chromaticity diagram according to the color coordinates of the target color;

in step S120, computing grayscale components of l primary colors corresponding to the target color in each of the at least one color triangle according to the color coordinates of the target color and an initial brightness component, wherein the initial brightness component is computed according to the following equation: $Y_0=Y/n$, where $Y_0$ is the initial brightness component, Y is the brightness of the target color, and n is the number of the at least one color triangle corresponding to the target color;

in step S130, adding up grayscale components of each same primary color respectively in the at least one color triangles corresponding to the target color, to obtain initial grayscales of l primary colors;

in step S140, judging whether there is an overflow grayscale in the initial grayscales of l primary colors, wherein the overflow grayscale is an initial grayscale whose grayscale value is greater than a grayscale threshold;

if there is no overflow grayscale in the initial grayscales of l primary colors, then performing step S160, if there is an overflow grayscale in the initial grayscales of l primary colors, then performing step S150;

in step S150, reducing initial brightness component corresponding to at least one of grayscale components greater than a grayscale component threshold among grayscale components of same primary color as the overflow grayscale, and adjusting initial brightness components corresponding to other grayscale components of the same primary color as the overflow grayscale, wherein, sum of all adjusted initial brightness components and all unadjusted initial brightness components is the brightness of the target color, computing grayscale components of l primary colors in color triangles including the primary color of the overflow grayscale according to the color coordinates of the target color and the adjusted initial brightness components after adjustment, and performing steps S130 and S140;

in step S160, determining the initial grayscales of l primary colors as grayscales of l primary colors of the target color in the l-primary-color color gamut space.

In an embodiment, in step S150, for any one of the at least one color triangle corresponding to the target color, if there is a vertex whose primary color is the same as the primary color of the overflow grayscale determined in step S140 among three vertices of the color triangle, then this color triangle is decided as a color triangle including the primary color of the overflow grayscale.

In an embodiment, positions of l primary colors in the l-primary-color system chromaticity diagram form l vertices, the at least one color triangle is obtained by connecting any three vertices among these l vertices, wherein, in step S110, the at least one color triangle corresponding to the target color are all color triangles within which the color coordinates of the target color lie.

In an embodiment, in step S120, grayscale components of three primary colors corresponding to the target color in any one of the at least one color triangle corresponding to the target color are computed using the following equation, and grayscale components of other primary colors that are not included in the color triangle corresponding to the target color are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_0 \\ Z \end{bmatrix};$$

where c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_0 + Z} \\ y = \dfrac{Y_0}{X + Y_0 + Z} \end{cases};$$

where, x is abscissa of the color coordinates of the target color;

y is ordinate of the color coordinates of the target color.

In an embodiment, in step S150, grayscale components of three primary colors corresponding to the target color in any one color triangle including the primary color of the overflow grayscale are computed using the following equation, and grayscale components of other primary colors that are not included in the color triangle including the primary color of the overflow grayscale are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_1 \\ Z \end{bmatrix};$$

where $Y_1$ is an adjusted initial brightness component;

c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_1 + Z} \\ y = \dfrac{Y_1}{X + Y_1 + Z} \end{cases};$$

where, x is abscissa of the color coordinates of the target color;

y is ordinate of the color coordinates of the target color.

In an embodiment, step S140 includes:

in step S141, sorting the initial grayscales of l primary colors, and acquiring a maximum of the initial grayscales of l primary colors;

in step S142, judging whether the maximum of the initial grayscales of l primary colors is greater than the grayscale threshold;

in step S143, if the maximum of the initial grayscales of l primary colors is greater than the grayscale threshold, then deciding that there is an overflow grayscale;

in step S144, if the maximum of the initial grayscales of l primary colors is smaller than or equal to the grayscale threshold, then deciding that there is no overflow grayscale.

In an embodiment, in step S150, reducing initial brightness component corresponding to at least one of grayscale components greater than a grayscale component threshold among grayscale components of the same primary color as the overflow grayscale, includes reducing an initial brightness component corresponding to a maximum of grayscale components of the same primary color as the overflow grayscale.

In an embodiment, in step S150, adjusting initial brightness components corresponding to other grayscale components of the same primary color as the overflow grayscale, includes increasing an initial brightness component corresponding to a minimum of grayscale components of the same primary color as the overflow grayscale.

In an embodiment, if the grayscale is a normalized grayscale, then the grayscale threshold is 1;

if the grayscale is an unnormalized grayscale, then the grayscale threshold is $2^{m-1}-1$, wherein m is a positive integer.

In an embodiment, the l primary colors comprise red, green, blue, yellow, cyan, and magenta.

In an embodiment, the grayscale component threshold is an average value of the initial grayscales of l primary colors.

As a second aspect of the present application, there is provided a driving method for driving a display panel to display an image to be displayed, wherein the display panel includes a plurality of display pixels, each of the display pixels includes l display sub-pixels having different colors, wherein, the driving method includes:

acquiring color information of a target color of each of image pixels in the image to be displayed;

computing grayscales of l display sub-pixels in a corresponding display pixel on the display panel according to the color information of the target color of each of image pixels, using the multiple primary color conversion method according to the present application, in the display pixel, each display sub-pixel corresponds to a color; and driving the display panel to display according to the grayscales of l display sub-pixels in each of the display pixels.

As a third aspect of the present application, there is provided a driving device for driving a display panel, wherein the display panel includes a plurality of display pixels, each of the display pixels includes l display sub-pixels having different colors, wherein, the driving device includes at least one processor and a memory for storing at least one program; wherein, the at least one program, when executed by the at least one processor, causes the at least one processor to perform the above driving method.

As a fourth aspect of the present application, there is provided a display apparatus, including a display panel and a driving device for driving the display panel, wherein the display panel includes a plurality of display pixels, each of the display pixels includes l display sub-pixels having different colors, wherein, the driving device is the driving device according to the present application.

In an embodiment, the plurality of display pixels include a red display sub-pixel, a green display sub-pixel, a blue display sub-pixel, a cyan display sub-pixel, a yellow display sub-pixel, and a magenta display sub-pixel.

BRIEF DESCRIPTION OF THE DRAWINGS

The accompanying drawings, which constitute a part of the specification, are provided for further understanding of the present disclosure, and for explaining the present disclosure along with the following specific implementations, but not intended to limit the present disclosure, in which:

FIG. 1(*b*) is a schematic diagram of step S140 of FIG. 1(*a*);

DETAILED DESCRIPTION

Embodiments of the present disclosure will be described in detail below in conjunction with the accompanying drawings. It should be understood that the embodiments described herein are solely for the purpose of explaining and interpreting the present disclosure rather than limiting the present disclosure.

At present, how to convert colors of each pixel in an image into drive data of each sub-pixel in a six-primary-color display panel has become a pressing technical problem to be solved in the field.

Figure 1A:
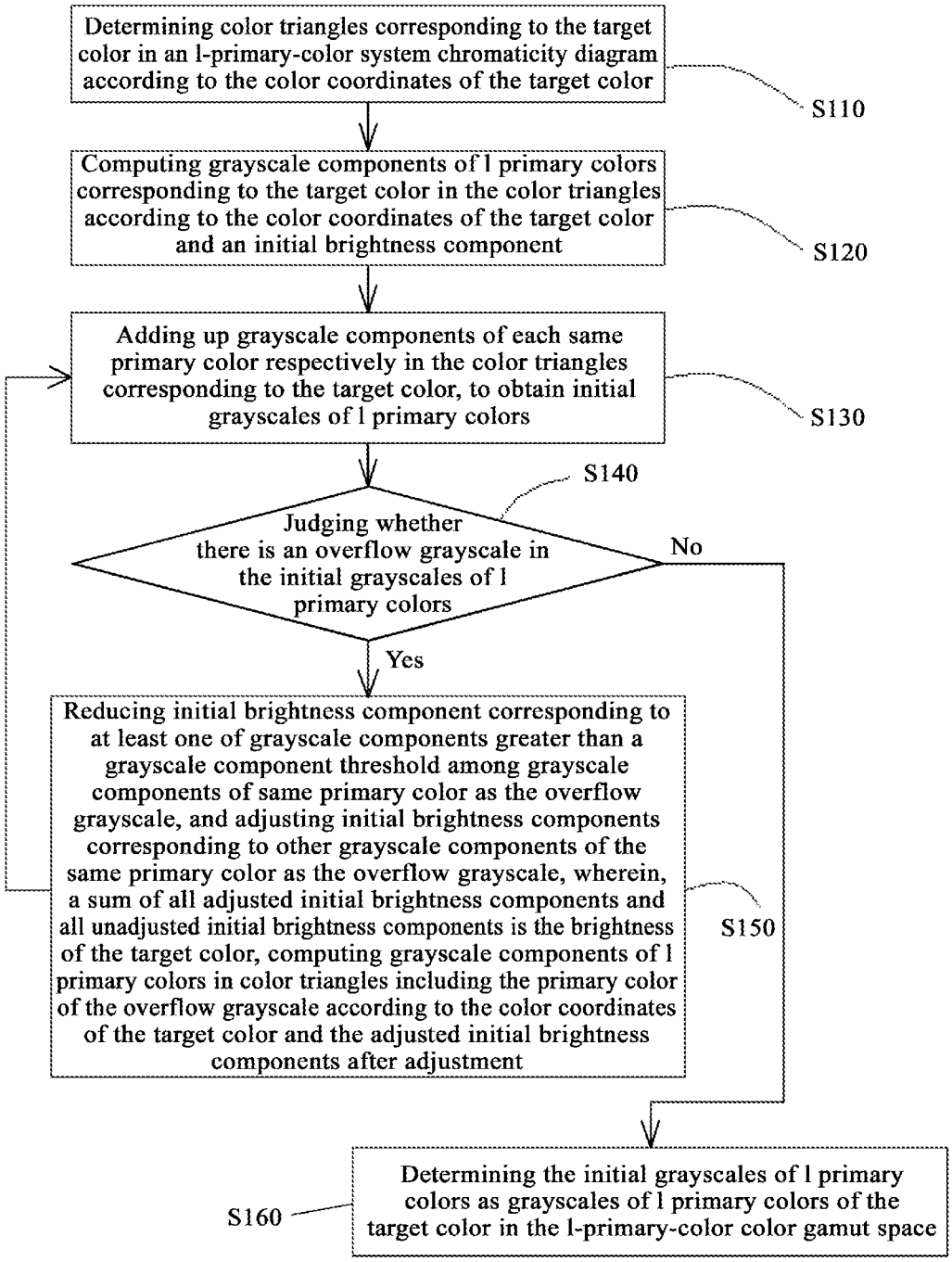
FIG. 1(*a*) is a flow chart of a method for computing stimulus values of a six primary colors of a target color according to color coordinates provided by the present application.
Figure 1B:
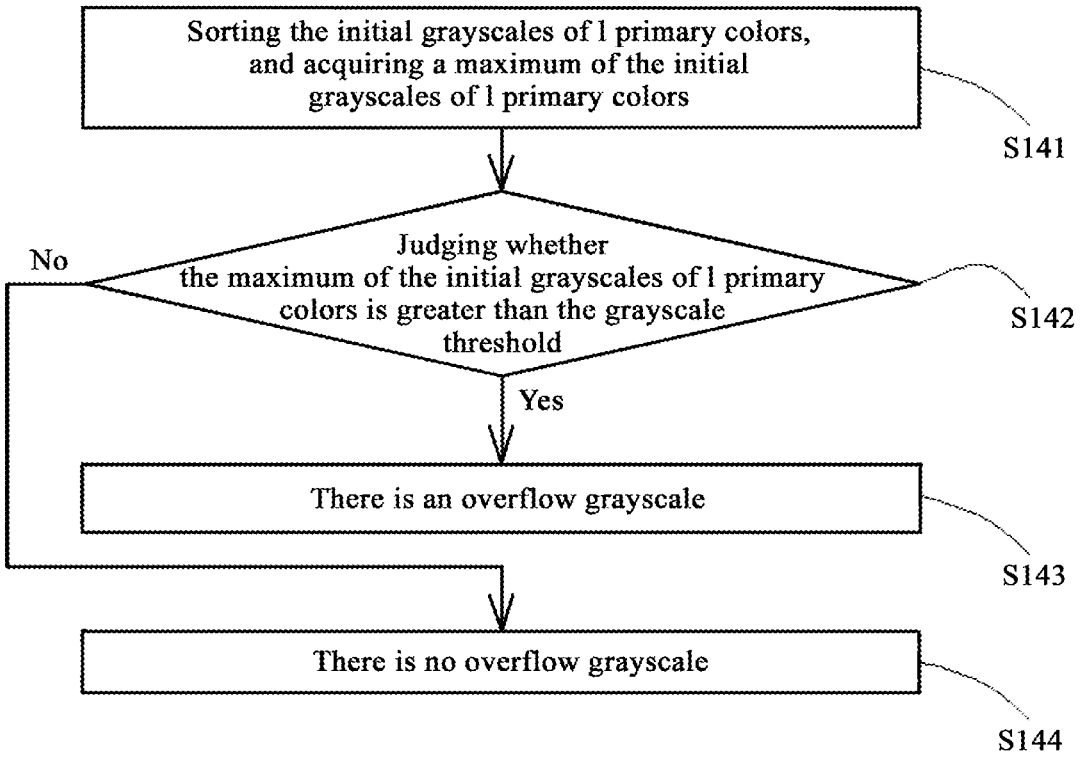

As one aspect of the present application, there is provided a multiple primary color conversion method, for computing grayscales of l primary colors of a target color in an l-primary-color color gamut space according to color information (x, y, Y) of the target color, and l is a positive integer greater than 3, the color information of the target color includes color coordinates (x, y) of the target color and a brightness Y of the target color. As shown in FIG. 1(*a*), the multiple primary color conversion method includes:

In step S110, determining at least one color triangle corresponding to the target color in an l-primary-color system chromaticity diagram according to color coordinates of the target color;

In step S120, computing grayscale components of l primary colors corresponding to the target color in the color triangles according to color coordinates of the target color and an initial brightness component, wherein the initial brightness component is computed according to the following equation: $Y_0=Y/n$, where $Y_0$ is the initial brightness component, Y is brightness of the target color, and n is number of the at least one color triangles corresponding to the target color;

In step S130, adding up grayscale components of each same primary color respectively in all of the color triangles corresponding to the target color, to obtain initial grayscales of l primary colors;

In step S140, judging whether there is an overflow grayscale in the initial grayscales of l primary colors, wherein the overflow grayscale is an initial grayscale whose grayscale value is greater than a grayscale threshold;

When there is no overflow grayscale in the initial grayscales of l primary colors, step S160 is performed, when there is an overflow grayscale in the initial grayscales of l primary colors, step S150 is performed;

In step S150, reducing initial brightness component corresponding to at least one of grayscale components greater than a grayscale component threshold among grayscale components of the same primary color as the overflow grayscale, and adjusting initial brightness components corresponding to other grayscale components of the same primary color as the overflow grayscale, wherein, sum of all adjusted initial brightness components and all unadjusted initial brightness components is the brightness of the target color, computing grayscale components of l primary colors in color triangles including the primary color of the overflow grayscale according to color coordinates of the target color and initial brightness components after adjustment, and performing steps S130 and S140;

In step S160, determining the initial grayscales of l primary colors as grayscales of l primary colors of the target color in the l-primary-color color gamut space.

It can be known from additive color mixing principle that, a color represented by any one point in each color triangle can be obtained by mixing three primary colors of triangle vertices at a certain proportion. In CIE1931xy chromaticity diagram, in a color gamut formed of l primary colors, the l primary colors can form $C_l^3$ different color triangles in total.

In the present application, the target color may be obtained by mixing l primary colors having predetermined grayscales (in a color gamut space having four colors of RGBYe, to obtain violet color, the red primary color has a grayscale of 255, the green primary color has a grayscale of 0, the blue primary color has a grayscale of 255, and the yellow primary color has a grayscale of 0), thus, brightness of color expressed by a grayscale component of each primary color is smaller than the brightness Y of the target color (that is, to obtain violet color, brightness of the red color having a grayscale of 255 is smaller than Y, brightness of the blue color having a grayscale of 255 is smaller than Y, and the total brightness is Y after mixing them). For ease of computation, in step S120, the brightness value of the target color is distributed equally between l primary colors.

In the present application, there is no particular requirements for grayscale. For example, the grayscale may be a normalized grayscale which is between 0 and 1. The grayscale may be an unnormalized grayscale which is between 0 and $2^{m-1}$. In the present application, there is no particular requirements for m, generally, m is an even number, for example, m may be 8.

When the grayscale is a normalized grayscale, the grayscale threshold is 1;

When the grayscale is an unnormalized grayscale, the grayscale threshold is $2^{m-1}-1$, when m is 8, the grayscale threshold is 255.

In the present application, there is no particular requirements for the grayscale component threshold. For example, the grayscale component threshold may be an average value of l initial grayscales, or may be other value which may be set according to specific requirements.

Step S130 is interpreted still taking the example of RGBYe four primary colors. In order to obtain initial grayscales of four primary colors of the target color, among all color triangles corresponding to the target color, grayscale components of red color obtained in all color triangles including a red vertex are added up to obtain an initial grayscale of red color. Among all color triangles corresponding to the target color, grayscale components of green color obtained in all color triangles including a green vertex are added up to obtain an initial grayscale of green color. Among all color triangles corresponding to the target color, grayscale components of blue color obtained in all color triangles including a blue vertex are added up to obtain an initial grayscale of blue color. Among all color triangles corresponding to the target color, grayscale components of yellow color obtained in all color triangles including a yellow vertex are added up to obtain an initial grayscale of yellow color.

If there is an overflow grayscale in the l initial grayscales obtained in step S130, then it indicates that the brightness of the target color is not apportioned appropriately in step S120. Then in step S150 (that is, iteration step), the brightness of the target color is redistributed newly. After newly distributing the brightness, steps S130 and S140 are performed again, until no overflow grayscale is found in l initial grayscales obtained in step S130.

In the present application, by the iteration step in step S150, inappropriate computation result can be adjusted accordingly, so as to obtain accurate grayscale components of primary colors in the multiple primary color space.

In step S150, for any one color triangle corresponding to the target color, if there is a vertex whose primary color is the same as primary color of the overflow grayscale determined in step S140 among three vertices of the color triangle, then this color triangle is decided as a color triangle including the primary color of the overflow grayscale.

In the example of RGBYe four primary colors, if the computed initial grayscale of red color is greater than the grayscale threshold (that is, the initial grayscale of red color is the overflow grayscale), then each color triangle including a red vertex among the color triangles corresponding to the target color are decided as the color triangle including the primary color of the overflow grayscale.

Positions of l primary colors in the l-primary-color system chromaticity diagram form l vertices, the color triangle is obtained by connecting any three vertices among these l vertices, and mixture of light corresponding to the l primary colors produces white light. In step S110, the color triangles corresponding to the target color are all color triangles within which color coordinates of the target color lie.

For example, in a color gamut formed of six primary colors, the six primary colors can form $C_6^3$ color triangles in total, that is, the six primary colors can form 20 different color triangles in total. Any one target color may be surrounded by n ($1<n<C_N^3$) triangles. Three primary colors of vertices of each one of these n color triangles can be mixed to get color coordinates of the target color.

In the art, conversion relationship between three stimulus values in CIE1931xy color gamut space and grayscales of RGB three primary colors satisfies equation (1.1). It can be seen from this that, with known three stimulus values in CIE1931xy color gamut space, grayscale values of RGB three primary colors can be computed using equation (1.2).

$$\begin{bmatrix} X \\ Y \\ Z \end{bmatrix} = \begin{bmatrix} X_R & X_G & X_B \\ Y_R & Y_G & Y_B \\ Z_R & Z_G & Z_B \end{bmatrix} \begin{bmatrix} R \\ G \\ B \end{bmatrix} \tag{1.1}$$

$$\begin{bmatrix} R \\ G \\ B \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X \\ Y \\ Z \end{bmatrix} \tag{1.2}$$

where R is red grayscale component of the target color in RGB color triangle;

G is green grayscale component of the target color in RGB color triangle;

B is blue grayscale component of the target color in RGB color triangle;

X is X stimulus value among three stimulus values corresponding to the target color in CIE1931xy color gamut space;

Y is Y stimulus value among three stimulus values corresponding to the target color in CIE1931xy color gamut space;

Z is Z stimulus value among three stimulus values corresponding to the target color in CIE1931xy color gamut space;

$$\begin{bmatrix} X_R & X_G & X_B \\ Y_R & Y_G & Y_B \\ Z_R & Z_G & Z_B \end{bmatrix}$$

is conversion matrix between primary color grayscales of RGB three-primary-color color gamut space and three stimulus values in CIE1931xy color gamut space, wherein each element of the conversion matrix is constant.

Accordingly, X stimulus value and Z stimulus value of the target color in CIE1931xy color gamut space can be computed according to color coordinates of the target color. Specifically, X stimulus value and Z stimulus value of the target color in CIE1931xy color gamut space are computed using equation (1.3).

$$\begin{cases} x = \dfrac{X}{X+Y+Z} \\ y = \dfrac{Y}{X+Y+Z} \end{cases} \tag{1.3}$$

where x is abscissa of color coordinates of the target color;

y is ordinate of color coordinates of the target color.

Accordingly, in step S120, grayscale components of three primary colors corresponding to the target color in any one color triangle corresponding to the target color can be computed using equation (2.1) below, and grayscale components of other primary colors that are not included in the color triangle corresponding to the target color are set 0.

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_0 \\ Z \end{bmatrix} \tag{2.1}$$

where c1 is grayscale component of the target color corresponding to primary color of a first vertex in the color triangle;

c2 is grayscale component of the target color corresponding to primary color of a second vertex in the color triangle;

c3 is grayscale component of the target color corresponding to primary color of a third vertex in the color triangle;

X is X stimulus value among three stimulus values corresponding to the target color in CIE1931xy color gamut space;

Z is Z stimulus value among three stimulus values corresponding to the target color in CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is conversion matrix between primary color grayscales in l-primary-color color gamut space and three stimulus values in CIE1931xy color gamut space, wherein each element of the conversion matrix is constant.

Accordingly, X stimulus value and Z stimulus value are computed according to the following equation (2.2):

$$\begin{cases} x = \dfrac{X}{X + Y_0 + Z} \\ y = \dfrac{Y_0}{X + Y_0 + Z} \end{cases} \tag{2.2}$$

where x is abscissa of color coordinates of the target color;

y is ordinate of color coordinates of the target color.

Equation (2.3) can be obtained according to equation (2.2), and X stimulus value and Z stimulus value corresponding to the target color in CIE1931xy color gamut space can be obtained by putting color coordinates into equation (2.3):

$$\begin{cases} X = \dfrac{x}{y}\dfrac{Y}{n} \\ Z = \dfrac{1 - x - y}{y}\dfrac{Y}{n} \end{cases} \tag{2.3}$$

Accordingly, in step S150, grayscale components of three primary colors corresponding to the target color in any one color triangle including primary color of the overflow grayscale can be computed using equation (2.4) below, and grayscale components of other primary colors that are not included in the color triangle including the primary color of the overflow grayscale are set 0.

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_1 \\ Z \end{bmatrix} \tag{2.4}$$

where Y1 is an adjusted initial brightness component;

c1 is grayscale component of the target color corresponding to primary color of a first vertex in the color triangle;

c2 is grayscale component of the target color corresponding to primary color of a second vertex in the color triangle;

c3 is grayscale component of the target color corresponding to primary color of a third vertex in the color triangle;

X is X stimulus value among three stimulus values corresponding to the target color in CIE1931xy color gamut space;

Z is Z stimulus value among three stimulus values corresponding to the target color in CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is conversion matrix between primary color grayscales in l-primary-color color gamut space and three stimulus values in CIE1931xy color gamut space, wherein each element of the conversion matrix is constant.

X stimulus value and Z stimulus value of the target color in CIE1931xy color gamut space are computed according to the following equation (2.5):

$$\begin{cases} x = \dfrac{X}{X + Y_1 + Z} \\ y = \dfrac{Y_1}{X + Y_1 + Z} \end{cases} \tag{2.5}$$

where x is abscissa of color coordinates of the target color;

y is ordinate of color coordinates of the target color.

In the present application, there is no particular requirement on how step S140 is performed, in order to save time required for computation, for example, as shown in FIG. 1(*b*), step S140 may include:

In step S141, sorting initial grayscales of l primary colors, and acquiring a maximum of the initial grayscales of l primary colors;

In step S142, judging whether the maximum of the initial grayscales of l primary colors is greater than the grayscale threshold;

In step S143, if the maximum of the initial grayscales of l primary colors is greater than the grayscale threshold, then deciding that there is the overflow grayscale;

In step S144, if the maximum of the initial grayscales of l primary colors is smaller than or equal to the grayscale threshold, then deciding that there is no overflow grayscale.

In the present application, there is no particular requirement on the initial brightness component corresponding to which specific primary color grayscale component is adjusted in step S150. For example, in step S150, reducing initial brightness component corresponding to at least one of grayscale components greater than a grayscale component threshold among grayscale components of the same primary color as the overflow grayscale, may include reducing initial brightness component corresponding to a maximum one of grayscale components of the same primary color as the overflow grayscale. Because the maximum one of grayscale components of the same color as the overflow grayscale has a relatively large margin for adjustment, adjusting the initial brightness component corresponding to the maximum one of grayscale components of the same primary color as the overflow grayscale can achieve quicker adjustment, and eventually eliminate overflow grayscale.

Likewise, a minimum one of grayscale components of the same color as the overflow grayscale has a relatively large margin for adjustment, thus, for example, in step S150, adjusting initial brightness components corresponding to other grayscale components of the same primary color as the overflow grayscale, may include increasing initial brightness component corresponding to the minimum one of grayscale components of the same primary color as the overflow grayscale.

In the present application, there is no particular requirement for the number of primary colors included in the multiple primary colors. In an embodiment, the multiple primary color conversion method is used to compute six primary color grayscales of the target color according to color information. That is, l may be 6, the six primary colors may be red, green, blue, yellow, cyan, and magenta, respectively. As stated in the foregoing, l may be 4.

An embodiment of the multiple primary color conversion method according to the present application will be described in detail below in conjunction with FIG. 2.

Figure 2:
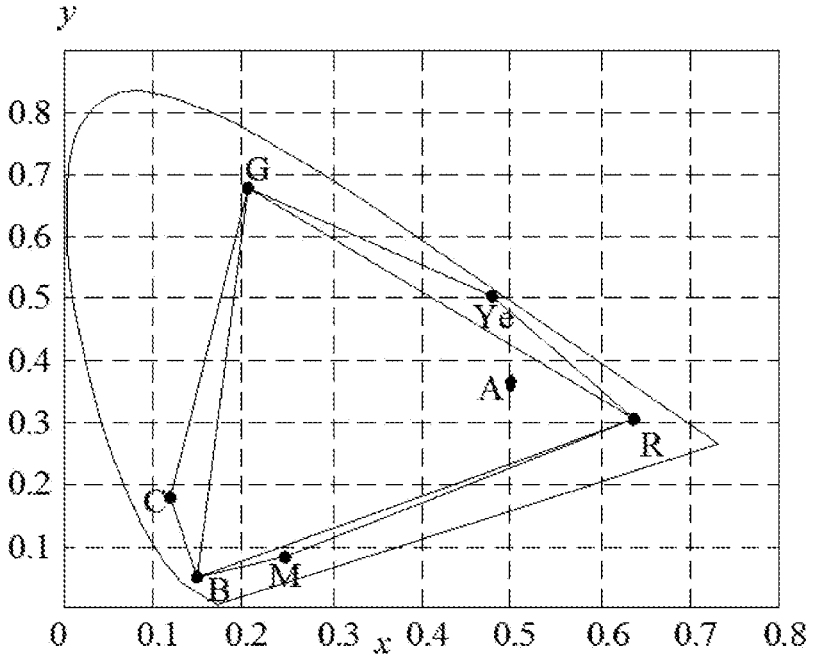
FIG. 2 is a schematic diagram of point A in a multi-primary-color system chromaticity diagram.

In FIG. 2, color coordinates and brightness information of the target color is known as (x, y, Y). According to the color coordinates of the target color, grayscales of primary colors of the target color in six-primary-color color gamut space are computed using the multiple primary color conversion method of the present application.

The target color is located at point A in multiple-primary-color chromaticity diagram. It can be seen from FIG. 2, the target color at point A is surrounded by 6 color triangles. The six color triangles are ΔRGB, ΔRGC, ΔRGM, ΔRYeC, ΔRYeM, ΔRYeB, respectively.

In ΔRGB, c1 is represented by $R_1$, c2 is represented by $G_1$, and c3 is represented by $B_1$. Color grayscale components of three vertices of ΔRGB are computed according to equation (5). $X_{c1}$ is represented by $X_R$, $X_{c2}$ is represented by $X_G$, $X_{c3}$ is represented by $X_B$. $Y_{c1}$ is represented by $Y_R$, $Y_{c2}$ is represented by $Y_G$, $Y_{c3}$ is represented by $Y_B$. $Z_{c1}$ is represented by $Z_R$, $Z_{c2}$ is represented by $Z_G$, $Z_{c3}$ is represented by $Z_B$.

Specifically, color grayscale components of three vertices of ΔRGB are as shown in equation (5).

$$\begin{bmatrix} R_1 \\ G_1 \\ B_1 \end{bmatrix} = \begin{bmatrix} X_R & X_G & X_B \\ Y_R & Y_G & Y_B \\ Z_R & Z_G & Z_B \end{bmatrix}^{-1} \begin{bmatrix} X \\ Y_0 \\ Z \end{bmatrix} \tag{5}$$

Yellow grayscale component $Ye_1$, cyan grayscale component $C_1$ and magenta grayscale component $M_1$ in ΔRGB are 0.

In ΔRGC, c1 is represented by $R_2$, c2 is represented by $G_2$, c3 is represented by $C_2$. Color grayscale components of three vertices of ΔRGC are computed according to equation (6). $X_{c1}$ is represented by $X_R$, $X_{c2}$ is represented by $X_G$, $X_{c3}$ is represented by $X_C$. $Y_{c1}$ is represented by $Y_R$, $Y_{c2}$ is represented by $Y_G$, $Y_{c3}$ is represented by $Y_C$. $Z_{c1}$ is represented by $Z_R$, $Z_{c2}$ is represented by $Z_G$, $Z_{c3}$ is represented by $Z_C$.

Specifically, color grayscale components of three vertices of ΔRGC are as shown in equation (6).

$$\begin{bmatrix} R_2 \\ G_2 \\ C_2 \end{bmatrix} = \begin{bmatrix} X_R & X_G & X_C \\ Y_R & Y_G & Y_C \\ Z_R & Z_G & Z_C \end{bmatrix}^{-1} \begin{bmatrix} X \\ Y_0 \\ Z \end{bmatrix} \tag{6}$$

Yellow grayscale component $Ye_2$, blue grayscale component $B_2$ and magenta grayscale component $M_2$ in ΔRGC are 0.

In ΔRGM, c1 is represented by $R_3$, c2 is represented by $G_3$, c3 is represented by $M_3$. Color grayscale components of three vertices of ΔRGM are computed according to equation (7). $X_{c1}$ is represented by $X_R$, $X_{c2}$ is represented by $X_G$, $X_{c3}$ is represented by $X_M$. $Y_{c1}$ is represented by $Y_R$, $Y_{c2}$ is represented by $Y_G$, $Y_{c3}$ is represented by $Y_M$. $Z_{c1}$ is represented by $Z_R$, $Z_{c2}$ is represented by $Z_G$, $Z_{c3}$ is represented by $Z_M$.

Specifically, color grayscale components of three vertices of ΔRGM are as shown in equation (7).

$$\begin{bmatrix} R_3 \\ G_3 \\ M_3 \end{bmatrix} = \begin{bmatrix} X_R & X_G & X_M \\ Y_R & Y_G & Y_M \\ Z_R & Z_G & Z_M \end{bmatrix}^{-1} \begin{bmatrix} X \\ Y_0 \\ Z \end{bmatrix} \tag{7}$$

Yellow grayscale component $Ye_3$, cyan grayscale component $C_3$ and blue grayscale component $B_3$ in ΔRGM are 0.

In ΔRYeC, c1 is represented by $R_4$, c2 is represented by $Ye_4$, c3 is represented by $C_4$. Color grayscale components of three vertices of ΔRYeC are computed according to equation (8). $X_{c1}$ is represented by $X_R$, $X_{c2}$ is represented by $X_{Ye}$, $X_{c3}$ is represented by $X_c$. $Y_{c1}$ is represented by $Y_R$, $Y_{c2}$ is represented by $Y_{Ye}$, $Y_{c3}$ is represented by $Y_c$. $Z_{c1}$ is represented by $Z_R$, $Z_{c2}$ is represented by $Z_{Ye}$, $Z_{c3}$ is represented by $Z_C$.

Specifically, color grayscale components of three vertices of ΔRYeC are as shown in equation (8).

$$\begin{bmatrix} R_4 \\ Ye_4 \\ C_4 \end{bmatrix} = \begin{bmatrix} X_R & X_{Ye} & X_C \\ Y_R & Y_{Ye} & Y_C \\ Z_R & Z_{Ye} & Z_C \end{bmatrix}^{-1} \begin{bmatrix} X \\ Y_0 \\ Z \end{bmatrix} \tag{8}$$

Green grayscale component $G_4$, blue grayscale component $B_4$ and magenta grayscale component $M_4$ in ΔRYeC are 0.

In ΔRYeM, c1 is represented by $R_5$, c2 is represented by $Ye_5$, c3 is represented by $M_5$. Color grayscale components of three vertices of ΔRYeM are computed according to equation (9). $X_{c1}$ is represented by $X_R$, $X_{c2}$ is represented by $X_{Ye}$, $X_{c3}$ is represented by $X_M$. $Y_{c1}$ is represented by $Y_R$, $Y_{c2}$ is represented by $Y_{Ye}$, $Y_{c3}$ is represented by $Y_M$. $Z_{c1}$ is represented by $Z_R$, $Z_{c2}$ is represented by $Z_{Ye}$, $Z_{c3}$ is represented by $Z_M$.

Specifically, color grayscale components of three vertices of ΔRYeM are as shown in equation (9).

$$\begin{bmatrix} R_5 \\ Ye_5 \\ C_5 \end{bmatrix} = \begin{bmatrix} X_R & X_{Ye} & X_M \\ Y_R & Y_{Ye} & Y_M \\ Z_R & Z_{Ye} & Z_M \end{bmatrix}^{-1} \begin{bmatrix} X \\ Y_0 \\ Z \end{bmatrix} \tag{9}$$

Green grayscale component $G_5$, blue grayscale component $B_5$ and cyan grayscale component $C_5$ in ΔRYeM are 0.

In ΔRYeB, c1 is represented by $R_6$, c2 is represented by $Ye_6$, c3 is represented by $B_6$. Color grayscale components of three vertices of ΔRYeB are computed according to equation (10). $X_{c1}$ is represented by $X_R$, $X_{c2}$ is represented by $X_{Ye}$, $X_{c3}$ is represented by $X_B$. $Y_{c1}$ is represented by $Y_R$, $Y_{c2}$ is represented by $Y_{Ye}$, $Y_{c3}$ is represented by $Y_B$. $Z_{c1}$ is represented by $Z_R$, $Z_{c2}$ is represented by $Z_{Ye}$, $Z_{c3}$ is represented by $Z_B$.

Specifically, color grayscale components of three vertices of ΔRYeB are as shown in equation (10).

$$\begin{bmatrix} R_6 \\ Ye_6 \\ B_6 \end{bmatrix} = \begin{bmatrix} X_R & X_{Ye} & X_B \\ Y_R & Y_{Ye} & Y_B \\ Z_R & Z_{Ye} & Z_B \end{bmatrix}^{-1} \begin{bmatrix} X \\ Y_0 \\ Z \end{bmatrix} \tag{10}$$

Green grayscale component $G_6$, magenta grayscale component $M_6$ and cyan grayscale component $C_6$ in ΔRYeB are 0.

According to equations (5) to (10), matrix of equation (11) can be obtained.

$$\begin{bmatrix} R_1 & G_1 & B_1 & Ye_1 & C_1 & M_1 \\ R_2 & G_2 & B_2 & Ye_2 & C_2 & M_2 \\ R_3 & G_3 & B_3 & Ye_3 & C_3 & M_3 \\ R_4 & G_4 & B_4 & Ye_4 & C_4 & M_4 \\ R_5 & G_5 & B_5 & Ye_5 & C_5 & M_5 \\ R_6 & G_6 & B_6 & Ye_6 & C_6 & M_6 \\ \sum R & \sum G & \sum B & \sum Ye & \sum C & \sum M \end{bmatrix} \tag{11}$$

In the present application, ΣR is initial red grayscale, ΣG is initial green grayscale, ΣB is initial blue grayscale, ΣYe is initial yellow grayscale, ΣC is initial cyan grayscale, ΣM is initial magenta grayscale.

Then the maximum of initial primary color grayscales is computed using the following equation (12).

$$\text{Fac_max}=[\Sigma R \Sigma G \Sigma B \Sigma Ye \Sigma C \Sigma M] \tag{12}$$

If the initial red grayscale is the greatest of the six initial grayscales and is greater than the grayscale threshold, then a color triangle whose red grayscale component is the greatest and a color triangle whose red grayscale component is the smallest are found out, and with total brightness of the 6 color triangles unchanged, initial brightness allocated to the color triangle whose red grayscale component is the greatest is reduced, and initial brightness allocated to the color triangle whose red grayscale component is the smallest is increased. Each initial grayscale is newly computed, until none of the initial grayscales is greater than the grayscale threshold.

Figure 3:
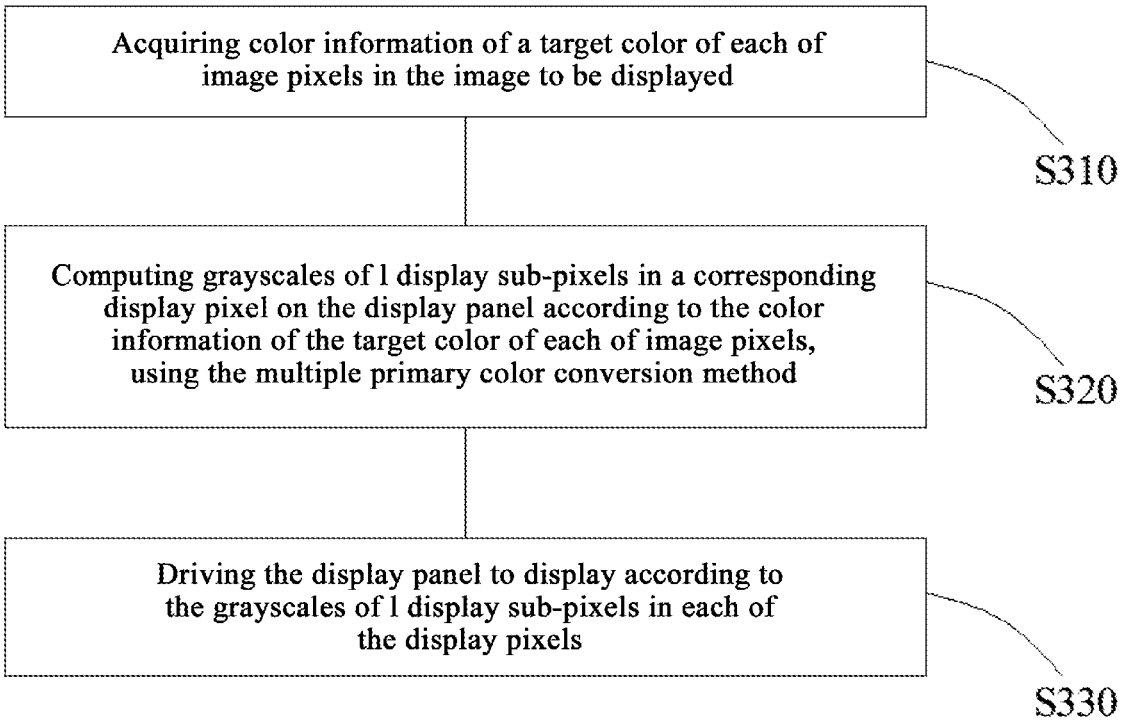
FIG. 3 is a flow chart of a driving method for driving a display panel to display an image to be displayed provided by the present application.

As a second aspect of the present application, there is provided a driving method for driving a display panel to display an image to be displayed, the display panel includes a plurality of display pixels, each of the display pixels includes a plurality of display sub-pixels having different colors, wherein, as shown in FIG. 3, the driving method includes:

In step S310, acquiring color information of a target color of each of image pixels in the image to be displayed;

In step S320, computing grayscales of l display sub-pixels in corresponding display pixels on the display panel according to color information of the target color of each of image pixels, using the above-described multiple primary color conversion method of the present application, wherein the target color in the above-described multiple primary color conversion method corresponds to the color of the image pixel, in the display pixel, each display sub-pixel corresponds to a color;

In step S330, driving the display panel to display according to display sub-pixels in l display pixels.

In the present application, final primary color grayscales obtained by computation are display grayscales of display sub-pixels in pixels.

It is to be explained that, the plurality of image pixels in the image to be displayed are in one-to-one correspondence with the plurality of display pixels in the display panel, the above-described multiple primary color conversion method provided by the present application is performed for each image pixel.

As a third aspect of the present application, there is provided a driving device, the driving device is used to perform the above-described driving method of the present application, that is, to drive the display panel. The display panel includes a plurality of display pixels, each of the display pixels includes l display sub-pixels with different colors, and the driving device includes at least one processor and a memory for storing at least one program; wherein, the at least one program, when executed by the at least one processor, causes the at least one processor to perform the above driving method.

Figure 4:
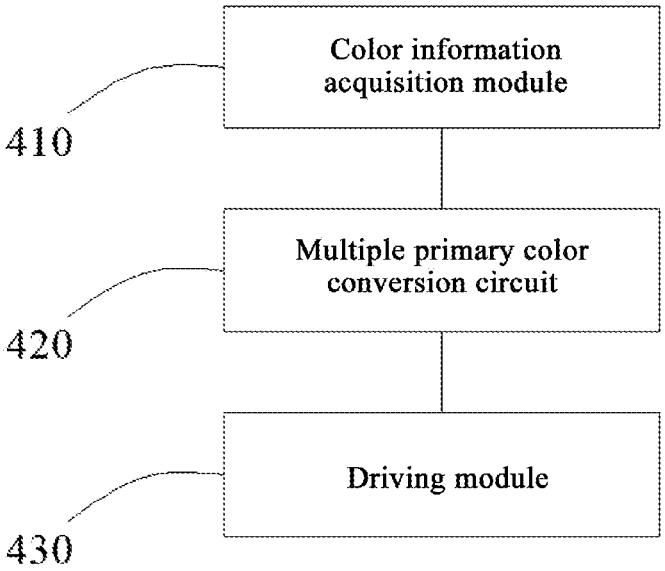
FIG. 4 is a schematic diagram of modules of a driving circuit provided by the present application.

Specifically, as shown in FIG. 4, the driving circuit includes a color information acquisition module 410, a multiple primary color conversion module 420, and a driving module 430.

The color information acquisition module 410 is used to perform step S310, that is, the color information acquisition module 410 is used to acquire color information of each image pixel in the image to be displayed.

The multiple primary color conversion circuit 420 is the above multiple primary color conversion module provided by the present application, the multiple primary color conversion circuit is used to perform step S320, wherein, color information of each of the image pixels corresponds to the color information of the target color, in the display pixel, each display sub-pixel corresponds to a primary color.

The driving module 430 is used to perform step S330, that is, the driving module 430 drives the display panel to display according to grayscales of l display sub-pixels in each display pixel.

As a fourth aspect of the present application, there is provided a display apparatus, the display apparatus includes a display panel and a driving device for driving the display panel, the display panel includes a plurality of display pixels, each of the display pixels includes l display sub-pixels having different colors, wherein the driving device is the above driving device provided by the present application.

For example, the display pixel includes a red display sub-pixel, a green display sub-pixel, a blue display sub-pixel, a cyan display sub-pixel, a yellow display sub-pixel, and a magenta display sub-pixel.

As another aspect of the present application, there may further be provided a computer readable storage medium, which is stored with instructions which, when the computer readable storage medium is run on a computer, cause the computer to perform the above described multiple primary color conversion method provided by the present application.

The driving device for driving a display panel provided by the present application includes at least one processor such as CPU, and a memory such as ROM for storing at least one program. When the at least one program is executed by the at least one processor, it causes the at least one processor to perform the foregoing driving method for driving the display panel.

Units or modules involved in embodiments of the present disclosure may be implemented by means of software, or may be implemented by means of hardware. Units or modules may be software programs provided in the processor, for example, units or modules may be software programs provided in a computer or a mobile smart apparatus; units or modules may also be a hardware device configured separately. Names of these units or modules do not pose any limit to the units or modules themselves.

It should be understood that, the above embodiments are only exemplary embodiments for the purpose of explaining the principle of the present disclosure, and the present disclosure is not limited thereto. For one of ordinary skill in the art, various improvements and modifications may be made without departing from the spirit and essence of the present disclosure. These improvements and modifications also fall within the protection scope of the present disclosure.

What is claimed is:

1. A multiple primary color conversion method, for computing grayscales of l primary colors of a target color in an l-primary-color color gamut space according to color information of the target color, wherein l is a positive integer greater than 3, the color information of the target color comprises color coordinates of the target color and a brightness of the target color, wherein, the multiple primary color conversion method comprises:

in step S110, determining at least one color triangle corresponding to the target color in an l-primary-color system chromaticity diagram according to the color coordinates of the target color;

in step S120, computing grayscale components of l primary colors corresponding to the target color in each of the at least one color triangle according to the color coordinates of the target color and an initial brightness component, wherein the initial brightness component is computed according to the following equation: $Y_0=Y/n$, where $Y_0$ is the initial brightness component, Y is the brightness of the target color, and n is the number of the at least one color triangle corresponding to the target color;

in step S130, adding up grayscale components of each same primary color respectively in the at least one color triangle corresponding to the target color, to obtain initial grayscales of l primary colors;

in step S140, judging whether there is an overflow grayscale in the initial grayscales of l primary colors, wherein the overflow grayscale is an initial grayscale whose grayscale value is greater than a grayscale threshold;

if there is no overflow grayscale in the initial grayscales of l primary colors, then performing step S160, if there is an overflow grayscale in the initial grayscales of l primary colors, then performing step S150;

in step S150, reducing the initial brightness component corresponding to at least one of grayscale components greater than a grayscale component threshold among grayscale components of same primary color as the overflow grayscale, and adjusting initial brightness components corresponding to other grayscale components of the same primary color as the overflow grayscale, wherein, a sum of all adjusted initial brightness components and all unadjusted initial brightness components is the brightness of the target color, computing grayscale components of l primary colors in color triangles including the primary color of the overflow grayscale according to the color coordinates of the target color and the adjusted initial brightness components, and performing steps S130 and S140;

in step S160, determining the initial grayscales of l primary colors as grayscales of l primary colors of the target color in the l-primary-color color gamut space.

2. The multiple primary color conversion method according to claim 1, wherein, in step S150, for each of the at least one color triangle corresponding to the target color, if there is a vertex whose primary color is the same as the primary color of the overflow grayscale determined in step S140 among three vertices of the color triangle, then the color triangle is decided as a color triangle including the primary color of the overflow grayscale.

3. The multiple primary color conversion method according to claim 1, wherein, positions of l primary colors in the l-primary-color system chromaticity diagram form l vertices, the at least one color triangle is obtained by connecting any three vertices among these l vertices, wherein, in step S110, the at least one color triangle corresponding to the target color are all color triangles within which the color coordinates of the target color lie.

4. The multiple primary color conversion method according to claim 1, wherein, in step S120, grayscale components of three primary colors corresponding to the target color in each of the at least one color triangle corresponding to the target color are computed using the following equation, and grayscale components of other primary colors that are not included in the color triangle corresponding to the target color are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_0 \\ Z \end{bmatrix};$$

where c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_0 + Z} \\ y = \dfrac{Y_0}{X + Y_0 + Z} \end{cases};$$

where, x is abscissa of the color coordinates of the target color;

y is ordinate of the color coordinates of the target color.

5. The multiple primary color conversion method according to claim 1, wherein in step S150, grayscale components of three primary colors corresponding to the target color in each color triangle including the primary color of the overflow grayscale are computed using the following equation, and grayscale components of other primary colors that are not included in the color triangle including the primary color of the overflow grayscale are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_1 \\ Z \end{bmatrix};$$

where $Y_1$ is an adjusted initial brightness component;

c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_1 + Z} \\ y = \dfrac{Y_1}{X + Y_1 + Z} \end{cases};$$

where, x is abscissa of the color coordinates of the target color;

y is ordinate of the color coordinates of the target color.

6. The multiple primary color conversion method according to claim 1, wherein, step S140 comprises:

in step S141, sorting the initial grayscales of l primary colors, and acquiring a maximum of the initial grayscales of l primary colors;

in step S142, judging whether the maximum of the initial grayscales of l primary colors is greater than the grayscale threshold;

in step S143, if the maximum of the initial grayscales of l primary colors is greater than the grayscale threshold, then deciding that there is an overflow grayscale;

in step S144, if the maximum of the initial grayscales of l primary colors is smaller than or equal to the grayscale threshold, then deciding that there is no overflow grayscale.

7. The multiple primary color conversion method according to claim 6, wherein, in step S150, reducing the initial brightness component corresponding to at least one of grayscale components greater than a grayscale component threshold among grayscale components of the same primary color as the overflow grayscale, comprises reducing the initial brightness component corresponding to a maximum of grayscale components of the same primary color as the overflow grayscale.

8. The multiple primary color conversion method according to claim 6, wherein, in step S150, adjusting initial brightness components corresponding to other grayscale components of the same primary color as the overflow grayscale, comprises increasing an initial brightness component corresponding to a minimum of grayscale components of the same primary color as the overflow grayscale.

9. The multiple primary color conversion method according to claim 1, wherein, if the grayscale is a normalized grayscale, then the grayscale threshold is 1;

if the grayscale is an unnormalized grayscale, then the grayscale threshold is $2^{m-1}-1$, wherein m is a positive integer.

10. The multiple primary color conversion method according to claim 1, wherein the l primary colors comprise red, green, blue, yellow, cyan, and magenta.

11. The multiple primary color conversion method according to claim 7, wherein the grayscale component threshold is an average value of the initial grayscales of l primary colors.

12. A driving method for driving a display panel to display an image to be displayed, wherein the display panel comprises a plurality of display pixels, each of the display pixels comprises l display sub-pixels having different colors, wherein, the driving method comprises:

acquiring color information of a target color of each of image pixels in the image to be displayed;

computing grayscales of l display sub-pixels in a corresponding display pixel on the display panel according to the color information of the target color of each of image pixels, using a multiple primary color conversion method, wherein in the display pixel, each display sub-pixel corresponds to a color; and driving the display panel to display according to the grayscales of l display sub-pixels in each of the display pixels, wherein the multiple primary color conversion method, for computing grayscales of l primary colors of a target color in an l-primary-color color gamut space according to color information of the target color, wherein l is a positive integer greater than 3, the color information of the target color comprises color coordinates of the target color and a brightness of the target color, wherein, the multiple primary color conversion method comprises:

in step S110, determining at least one color triangle corresponding to the target color in an l-primary-color system chromaticity diagram according to the color coordinates of the target color;

in step S120, computing grayscale components of l primary colors corresponding to the target color in each of the at least one color triangle according to the color coordinates of the target color and an initial brightness component, wherein the initial brightness component is computed according to the following equation: $Y_0=Y/n$, where $Y_0$ is the initial brightness component, Y is the brightness of the target color, and n is the number of the at least one color triangle corresponding to the target color;

in step S130, adding up grayscale components of each same primary color respectively in the at least one color triangle corresponding to the target color, to obtain initial grayscales of l primary colors;

in step S140, judging whether there is an overflow grayscale in the initial grayscales of l primary colors, wherein the overflow grayscale is an initial grayscale whose grayscale value is greater than a grayscale threshold;

if there is no overflow grayscale in the initial grayscales of l primary colors, then performing step S160, if there is an overflow grayscale in the initial grayscales of l primary colors, then performing step S150;

in step S150, reducing the initial brightness component corresponding to at least one of grayscale components greater than a grayscale component threshold among grayscale components of same primary color as the overflow grayscale, and adjusting initial brightness component, corresponding to other grayscale components of the same primary color as the overflow grayscale, wherein, a sum of all adjusted initial brightness components and all unadjusted initial brightness components is the brightness of the target color, computing grayscale components of l primary colors in color triangles including the primary color of the overflow grayscale according to the color coordinates of the target color and the adjusted initial brightness components, and performing steps S130 and S140;

in step S160, determining the initial grayscales of l primary colors as grayscales of l primary colors of the target color in the l-primary-color color gamut space.

13. A driving device for driving a display panel, wherein the display panel comprises a plurality of display pixels, each of the display pixels comprises l display sub-pixels having different colors, wherein, the driving device comprises at least one processor and a memory for storing at least one program; wherein, the at least one program, when executed by the at least one processor, causes the at least one processor to perform a driving method, wherein the driving method comprises:

acquiring color information of a target color of each of image pixels in the image to be displayed;

computing grayscales of l display sub-pixels in a corresponding display pixel on the display panel according to the color information of the target color of each of image pixels, using a multiple primary color conversion method, wherein in the display pixel, each display sub-pixel corresponds to a color; and driving the display panel to display according to the grayscales of l display sub-pixels in each of the display pixels, wherein the multiple primary color conversion method, for computing grayscales of l primary colors of a target color in an l-primary-color color gamut space according to color information of the target color, wherein l is a positive integer greater than 3, the color information of the target color comprises color coordinates of the target color and a brightness of the target color, wherein, the multiple primary color conversion method comprises:

in step S110, determining at least one color triangle corresponding to the target color in an l-primary-color system chromaticity diagram according to the color coordinates of the target color;

in step S120, computing grayscale components of l primary colors corresponding to the target color in each of the at least one color triangle according to the color coordinates of the target color and an initial brightness component, wherein the initial brightness component is computed according to the following equation: $Y_0=Y/n$, where $Y_0$ is the initial brightness component, Y is the brightness of the target color, and n is the number of the at least one color triangle corresponding to the target color;

in step S130, adding up grayscale components of each came primary color respectively in the at least one color triangle corresponding to the target color, to obtain initial grayscales of l primary colors;

in step S140, judging whether there is an overflow grayscale in the initial grayscales of l primary colors, wherein the overflow grayscale is an initial grayscale whose grayscale value is greater than a grayscale threshold;

if there is no overflow grayscale in the initial grayscales of l primary colors, then performing step S160, if there is an overflow grayscale in the initial grayscales of l primary colors, then performing step S150;

in step S150, reducing the initial brightness component corresponding to at least one of grayscale components greater than a grayscale component threshold among grayscale components of same primary color as the overflow grayscale, and adjusting initial brightness components corresponding to other grayscale components of the same primary color as the overflow grayscale, wherein, a sum of all adjusted initial brightness components and all unadjusted initial brightness components is the brightness of the target color, computing grayscale components of l primary colors in color triangles including the primary color of the overflow grayscale according to the color coordinates of the target color and the adjusted initial brightness components, and performing steps S130 and S140;

in step S160, determining the initial grayscales of l primary colors as grayscales of l primary colors of the target color in the l-primary-color color gamut space.

14. A display apparatus, comprising a display panel and a driving device for driving the display panel, wherein the display panel comprises a plurality of display pixels, each of the display pixels comprises l display sub-pixels having different colors, wherein, the driving device comprises at least one processor and a memory for storing at least one program; wherein, the at least one program, when executed by the at least one processor, causes the at least one processor to perform a driving method, wherein the driving method for driving a display panel to display an image to be displayed, wherein the display panel comprises a plurality of display pixels, each of the display pixels comprises l display sub-pixels having different colors, wherein, the driving method comprises:

acquiring color information of a target color of each of image pixels in the image to be displayed;

computing grayscales of l display sub-pixels in a corresponding display pixel on the display panel according to the color information of the target color of each of image pixels, using a multiple primary color conversion method, wherein in the display pixel, each display sub-pixel corresponds to a color; and driving the display panel to display according to the grayscales of l display sub-pixels in each of the display pixels, wherein the multiple primary color conversion method, for computing grayscales of l primary colors of a target color in an l-primary-color color gamut space according to color information of the target color, wherein l is a positive integer greater than 3, the color information of the target color comprises color coordinates of the target color and a brightness of the target color, wherein, the multiple primary color conversion method comprises:

in step S110, determining at least one color triangle corresponding to the target color in an l-primary-color system chromaticity diagram according to the color coordinates of the target color;

in step S120, computing grayscale components of l primary colors corresponding to the target color in each of the at least one color triangle according to the color coordinates of the target color and an initial brightness component, wherein the initial brightness component is computed according to the following equation: $Y_0=Y/n$, where $Y_0$ is the initial brightness component, Y is the brightness of the target color, and n is the number of the at least one color triangle corresponding to the target color;

in step S130, adding up grayscale components of each same primary color respectively in the at least one color triangle corresponding to the target color, to obtain initial grayscales of l primary colors;

in step S140, judging whether there is an overflow grayscale in the initial grayscales of l primary colors, wherein the overflow grayscale is an initial grayscale whose grayscale value is greater than a grayscale threshold;

if then is no overflow grayscale in the initial grayscale, of l primary colors, then performing step S160, if there is an overflow grayscale in the initial grayscales of l primary colors, then performing step S150;

in step S150, reducing the initial brightness component corresponding to at least one of grayscale components greater than a grayscale component threshold among grayscale components of same primary color as the overflow grayscale, and adjusting initial brightness components corresponding to other grayscale components of the same primary color as the overflow grayscale, wherein, a sum of all adjusted initial brightness components and all unadjusted initial brightness components is the brightness of the target color, computing grayscale components of l primary colors in color triangles including the primary color of the overflow grayscale according to the color coordinates of the target color and the adjusted initial brightness components, and performing steps S130 and S140;

in step S160, determining the initial grayscales of l primary colors as grayscales of l primary colors of the target color in the l-primary-color color gamut space.

15. The display apparatus according to claim 14, wherein the plurality of display pixels comprise a red display sub-pixel, a green display sub-pixel, a blue display sub-pixel, a cyan display sub-pixel, a yellow display sub-pixel, and a magenta display sub-pixel.

16. The multiple primary color conversion method according to claim 2, wherein, in step S120, grayscale components of three primary colors corresponding to the target color in each of the at least one color triangle corresponding to the target color are computed using the following equation, and grayscale components of other primary colors that are not included in the color triangle corresponding to the target color are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_0 \\ Z \end{bmatrix};$$

where c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_0 + Z} \\ y = \dfrac{Y_0}{X + Y_0 + Z} \end{cases};$$

where, x is abscissa of the color coordinates of the target color;

y is ordinate of the color coordinates of the target color.

17. The multiple primary color conversion method according to claim 2, wherein in step S150, grayscale components of three primary colors corresponding to the target color in each color triangle including the primary color of the overflow grayscale are computed using the following equation, and grayscale components of other primary colors that are not included in the color triangle including the primary color of the overflow grayscale are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_1 \\ Z \end{bmatrix};$$

where $Y_1$ is an adjusted initial brightness component;

c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_1 + Z} \\ y = \dfrac{Y_1}{X + Y_1 + Z} \end{cases};$$

where, x is abscissa of the color coordinates of the target color;

y is ordinate of the color coordinates of the target color.

18. The multiple primary color conversion method according to claim 2, wherein, step S140 comprises:

in step S141, sorting the initial grayscales of l primary colors, and acquiring a maximum of the initial grayscales of l primary colors;

in step S142, judging whether the maximum of the initial grayscales of l primary colors is greater than the grayscale threshold;

in step S143, if the maximum of the initial grayscales of l primary colors is greater than the grayscale threshold, then deciding that there is an overflow grayscale;

in step S144, if the maximum of the initial grayscales of l primary colors is smaller than or equal to the grayscale threshold, then deciding that there is no overflow grayscale.

19. The multiple primary color conversion method according to claim 3, wherein, in step S120, grayscale components of three primary colors corresponding to the target color in each of the at least one color triangle corresponding to the target color are computed using the following equation, and grayscale components of other primary colors that are not included in the color triangle corresponding to the target color are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_0 \\ Z \end{bmatrix};$$

where c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_0 + Z} \\ y = \dfrac{Y_0}{X + Y_0 + Z} \end{cases};$$

where, x is abscissa of the color coordinates of the target color;

y is ordinate of the color coordinates of the target color.

20. The multiple primary color conversion method according to claim 3, wherein in step S150, grayscale components of three primary colors corresponding to the target color in each color triangle including the primary color of the overflow grayscale are computed using the following equation, and grayscale components of other primary colors that are not included in the color triangle including the primary color of the overflow grayscale are set 0:

$$\begin{bmatrix} c1 \\ c2 \\ c3 \end{bmatrix} = \begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}^{-1} \begin{bmatrix} X \\ Y_1 \\ Z \end{bmatrix};$$

where $Y_1$ is an adjusted initial brightness component;

c1 is a grayscale component of the target color corresponding to a primary color of a first vertex in the color triangle;

c2 is a grayscale component of the target color corresponding to a primary color of a second vertex in the color triangle;

c3 is a grayscale component of the target color corresponding to a primary color of a third vertex in the color triangle;

X is an X stimulus value among three stimulus values corresponding to the target color in a CIE1931xy color gamut space;

Z is a Z stimulus value among three stimulus values corresponding to the target color in the CIE1931xy color gamut space;

$$\begin{bmatrix} X_{c1} & X_{c2} & X_{c3} \\ Y_{c1} & Y_{c2} & Y_{c3} \\ Z_{c1} & Z_{c2} & Z_{c3} \end{bmatrix}$$

is a conversion matrix between primary color grayscales in the l-primary-color color gamut space and three stimulus values in the CIE1931xy color gamut space, wherein each element of the conversion matrix is constant;

the X stimulus value and the Z stimulus value are computed according to the following equation:

$$\begin{cases} x = \dfrac{X}{X + Y_1 + Z} \\ y = \dfrac{Y_1}{X + Y_1 + Z} \end{cases};$$

where, x is abscissa of the color coordinates of the target color;

y is ordinate of the color coordinates of the target color.

* * * * *